United States Patent [19]

Guichon

[11] Patent Number: 4,919,485

[45] Date of Patent: Apr. 24, 1990

[54] SEATS CONSTRUCTED OF INTERLOCKING ELEMENTS

[75] Inventor: Jean-Paul Guichon, Pratz, France

[73] Assignee: Grosfillex S.A.R.L., Arbent, France

[21] Appl. No.: 208,750

[22] Filed: Jun. 20, 1988

[51] Int. Cl.[5] ..... A47C 4/02

[52] U.S. Cl. ..... 297/443; 297/440

[58] Field of Search ..... 297/443, 440, 444, 377, 297/357

[56] References Cited

U.S. PATENT DOCUMENTS

| | | | |
|---|---|---|---|
| 984,709 | 2/1911 | Ruggles | 297/443 X |
| 1,256,856 | 2/1918 | Wittwer, Sr. | 297/375 |
| 1,652,165 | 12/1927 | Craven | 297/443 |
| 2,650,657 | 9/1953 | Ohlsson | 297/443 X |
| 2,968,338 | 1/1971 | Reese | 297/443 X |
| 4,365,840 | 12/1982 | Kehl et al. | 297/444 X |
| 4,563,040 | 1/1986 | Alster | 297/443 X |

*Primary Examiner*—Peter A. Aschenbrenner

*Attorney, Agent, or Firm*—Dowell & Dowell

[57] ABSTRACT

A chair having assemblable components wherein the seat and back have locking studs of irregular configuration which are selectively receivable within profiled openings in the sides of the chair when the back and seat are in first position and which are locked within the openings as the seat and back are rotated to a proper use position and wherein the seat includes outwardly extending lugs which are cooperatively received in bearings formed in the sides of the chair when the seat is moved to a use position.

15 Claims, 9 Drawing Sheets

SEATS CONSTRUCTED OF INTERLOCKING ELEMENTS

BACKGROUND OF THE INVENTION

1. Field of the Invention

This invention is generally directed to chairs, seats, benches and the like which may be readily assembled and disassembled without the requirement for tools by having seats and backs having portions which are interfitted with or abut portions of the sides of the chairs and which are retained in an assembled relationship when the chair is in assembled ready-to-use configuration.

2. History of the Related Art

In order to reduce bulkiness and thereby facilitate storage and transporation, it is known that armchairs and other seats have been proposed where the four main elements, the seat, back and both sides are distinct components capable of being easily assembled and disassembled by an individual. It may be noted, however, that the solutions adopted to date have not proven fully satisfactory by reasons of the complexity of assembly and disassembly; the need for separate assembling parts that can become lost or misplaced or because of the inadequate rigidity of the chair or seat when assembled.

SUMMARY OF THE INVENTION

The major purpose of the present invention is to remedy the aforementioned disadvantages with respect to assemblable chairs or seats.

In the chairs according to the invention, the front part of the seat and the middle part of the back are assembled with the sides by means of oppositely oriented side buttons or locking studs which have an irregular profile. By proper orientation of the back and the seat, the locking studs may be inserted into openings of an appropriate profile in the sides of the chair and will be held within the openings when the back and seat are suitably tilted to a proper use orientation with respect to the sides of the chair. The rear part of the seat includes projecting lugs that are selectively engageable in mating bearings provided in the sides of the chair when the seat is rotated to its use position.

It is understood that such a chair does not necessitate any separate assembling parts and that it may be assembled by any user without requiring tools. It will be noted, moreover, that a real clamping effect is achieved between the four chair elements with the absolute elimination of undesirable play therebetween.

It would be further noted that the invention permits the construction of chair seats with inclining or adjustable backs and by means of appropriate reinforcements and intermediate supports, it is possible to construct multiple seats in the form of benches or the like.

BRIEF DESCRIPTION OF THE DRAWINGS

The features of the present invention will become apparent from the following detailed description with reference to the accompanying drawings which are submitted for the purpose of illustration alone and which.

DESCRIPTION OF THE PREFERRED EMBODIMENT

Figure 1:
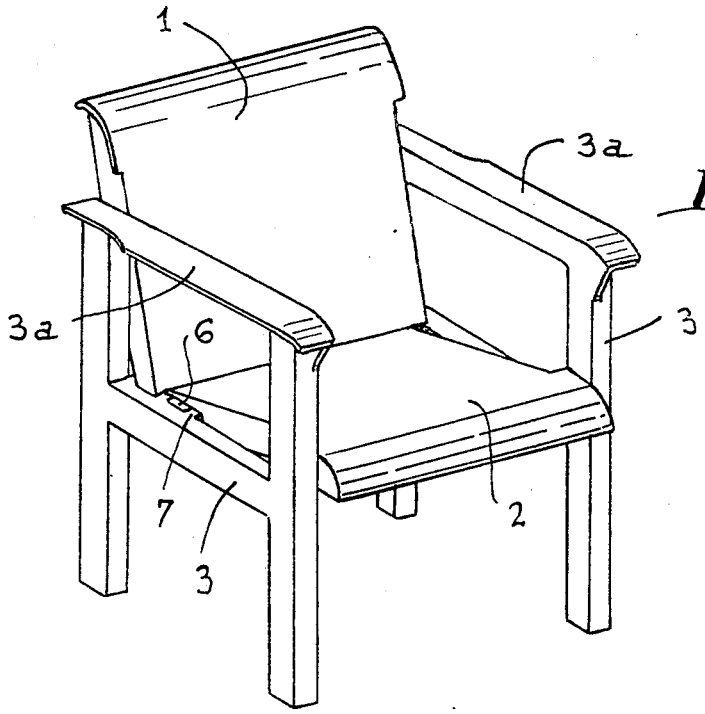
FIG. 1 is a perspective view of a chair or seat according to the invention in the form of arm chair.
Figure 2:
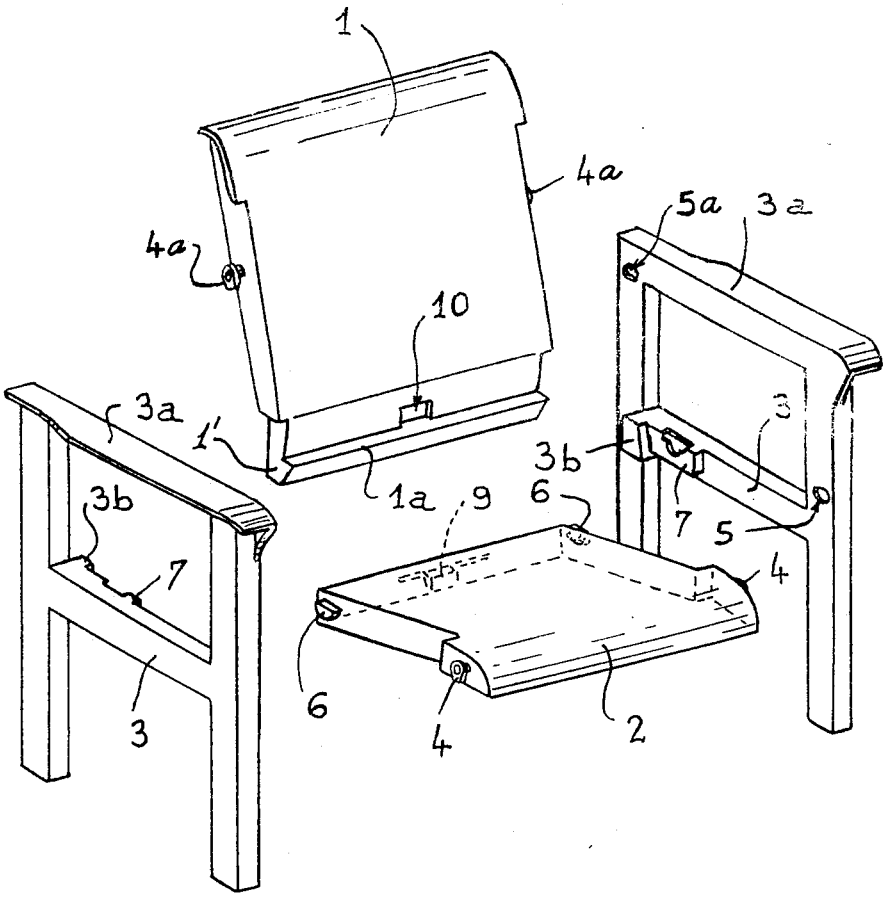
FIG. 2 is a perspective view of the four components of the seat or chair shown in FIG. 1, before their assembly.

The chair illustrated in FIGS. 1 and 2 includes four distinct elements, a back 1, a seat 2 and two vertically sides 3. The top portion of each side is configured in order to create an armrest 3*a* or to be fitted with such an armrest.

Figure 3:
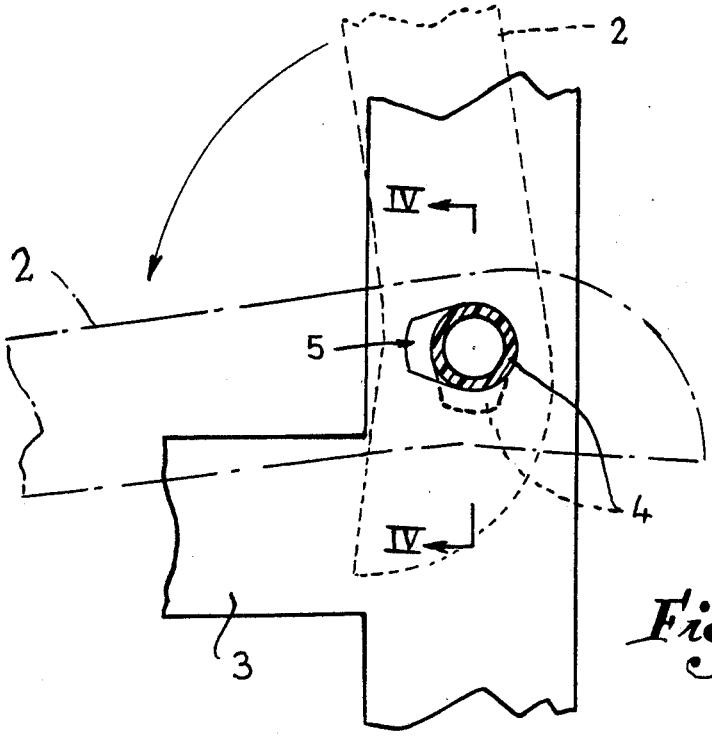
FIG. 3 is a vertical detailed section showing the assembling of the front seat portion and one of the sides of the chair of FIG. 1.
Figure 4:
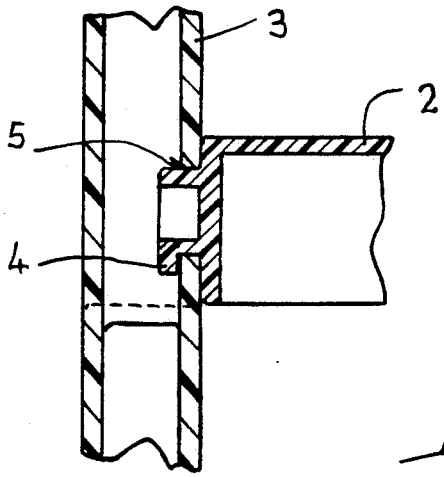
FIG. 4 is a cross section taken along lines IV—IV in FIG. 3.

According to the invention and as illustrated more particularly in FIGS. 2, 3 and 4, the front portion of the seat 2 comprises two side buttons or locking studs 4 which extend outwardly on opposite sides thereof and which are configured to include a cylindrical portion integral with an irregularly shaped outer heel or flange portion. Similarly, in the inner wall of each side 3, an opening 5 of a complementary shape has been provided. The openings are oriented so that by suitably tilting the seat 2 with respect to both sides 3 (shown at 2' in FIG. 3), it is possible to insert the buttons or locking studs 4 into the openings 5. Thereafter, the locking studs or buttons are locked in position in the openings as the seat 2 is tilted down to a horizontal or use position.

The same assembly system which includes side buttons or locking studs 4*a* and the respective openings 5*a* has been adopted for the attachment of the back 1 to both sides 3. As shown in FIG. 2, the buttons or locking studs 4*a* are provided in the middle portion of the back 1 in order to cooperate with openings 5*a* provided at the top part of sides 3 in the region of the armrest 3*a*. In this case, the insertion of the buttons or locking studs 4*a* in openings 5*a* involves a practically horizontal positioning of the back 1 which is then tilted up to a vertical position in order to achieve locking.

Figure 5:
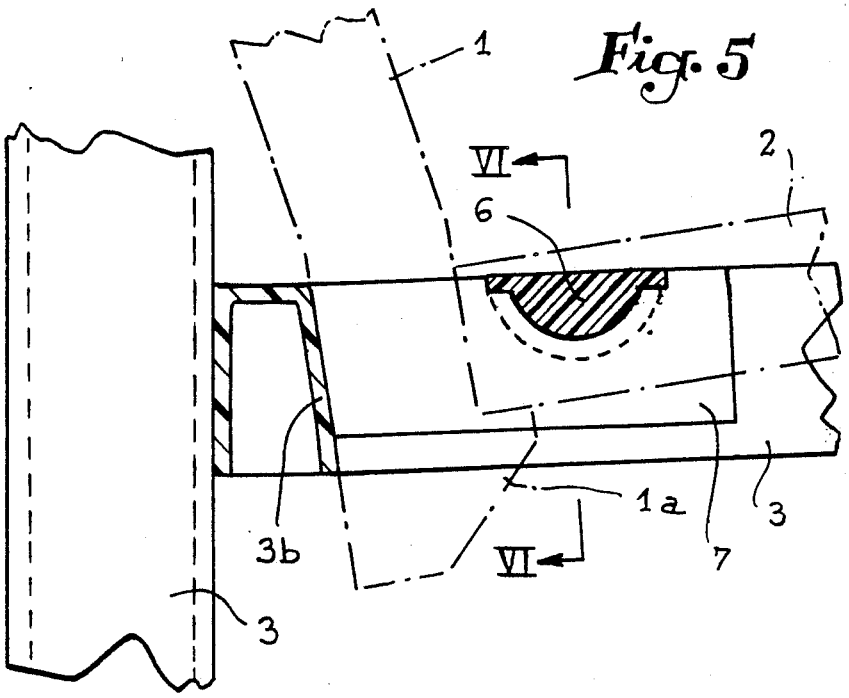
FIGS. 5 and 6 are similar cross sections showing the assembly of the rear seat portion and one of the sides of the chair of FIG. 1.

The back base 1' comes to rest against the rear stop 3*b* (FIG. 5) provided for this purpose on each side 3. This base comprises a nose or ledge 1*a* projecting forward in order to form a horizontal bearing designed to accommodate the rear portion of the seat 2 when the seat is tilted down to a use position.

Figure 6:
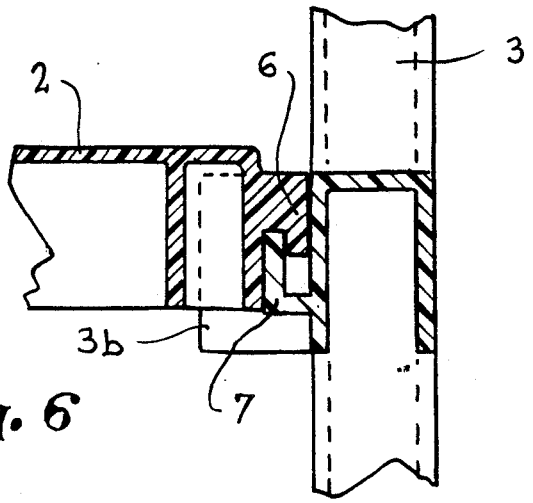

It should be observed (FIGS. 2, 5 and 6) that the rear portion of the seat 2 comprises two oppositely oriented outwardly projecting side lugs 6 which, when the seat reaches the generally horizontal or use position, come to be inserted in side bearings 7 provided in the inner side walls 3. The bearings are arranged in order to provide a rest for the lugs.

Figure 7:
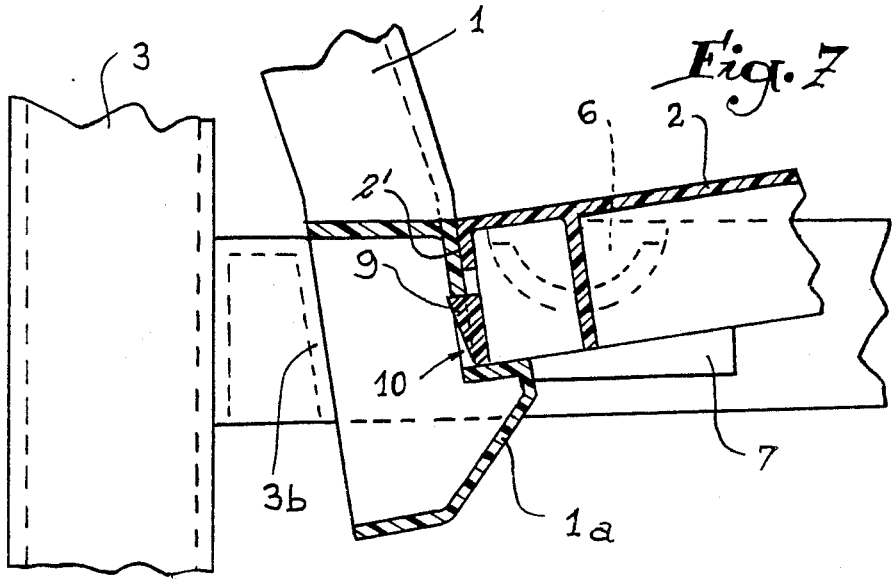
FIG. 7 is a cross section showing the mechanism for mutually locking the seat and back in their operative position.

In order to prevent any undesired movement of the seat 2 when the chair is being handled, a locking system has been provided comprising, in the example shown in FIG. 7, a tooth 9 that is integral with the rear edge 2' of the seat and is configured in order to fit like a spring catch in an opening 10 provided at the base of back 1. The opening is adjacent to and above the nose or ledge 3*b* of the back.

Figure 8:
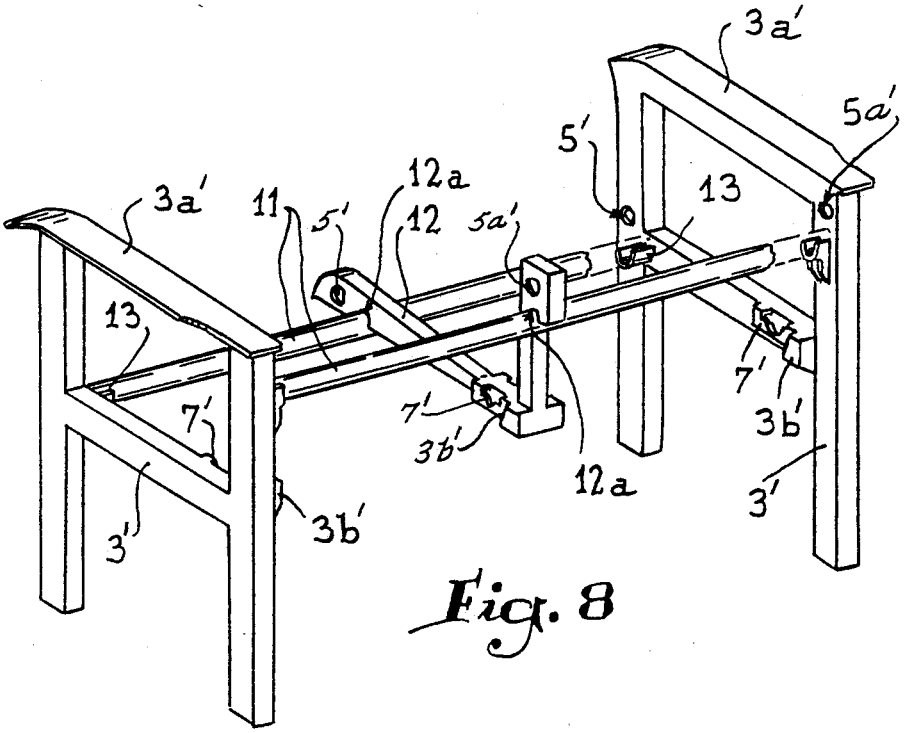
FIG. 8 is a perspective view of a framework of a two-seater bench obtained by means of two sides, an intermediate support, and two reinforcement bars, the backs and both seats are not shown.

Since the elements of the chair can be disassembled, they are suitable to create multi-seater seats or chairs in the form of a bench or the like. FIG. 8 shows a two-seater bench where the two sides 3' have armrests 3*a*' which are linked by two reinforcement tube bars 11, in order to, in association with the middle support 12, form a framework which will support two backs and two seats such as shown at 1 and 2 in FIG. 1.

The ends of the horizontal bars 11 engage into brackets 12 provided on the inner wall of each side 3' while the intermediary or middle support 12 includes bearings 12*a* that are open downwardly in order to rest on the bars. The supports are thus suspended from the bars. The components of this frame are held together by means of two backs and two seats (similar to those shown at FIG. 1), the side buttons or locking studs of which cooperate either with the openings 5' or 5*a*' of sides 3', or with similar openings 5' or 5*a*' provided in the intermediate support 12. The intermediate support and the sides also include lateral bearings 7' which accommodate the lugs 6 of the seats 2 (such as shown in FIG. 1) so that all the bench components are fully clamped and constitute a rigid assembly.

The length of bars 11 obviously varies according to the number of seat positions desired for the intended bench and this length is in all cases a multiple of the width of one seat 2. In order to sustain the bars 11 when their length is very large, the intermediate support shown as item 12 in FIG. 8 can be replaced by the support 14 shown in FIG. 9. The support 14 is provided with feet 14' which rest on the floor; in this case, the bearings 14*a* are open upwardly in order to carry bars 11.

The intermediate supports 12 or 14 can obviously be fitted with armrests similar to those of sides 3'. On the other hand, the back 1 of any of the seats of the bench can be removed, the seat 2 being substituted with a horizontal plate configured as as shelf that may be arranged to carry a flower box or similar item.

Figure 10:
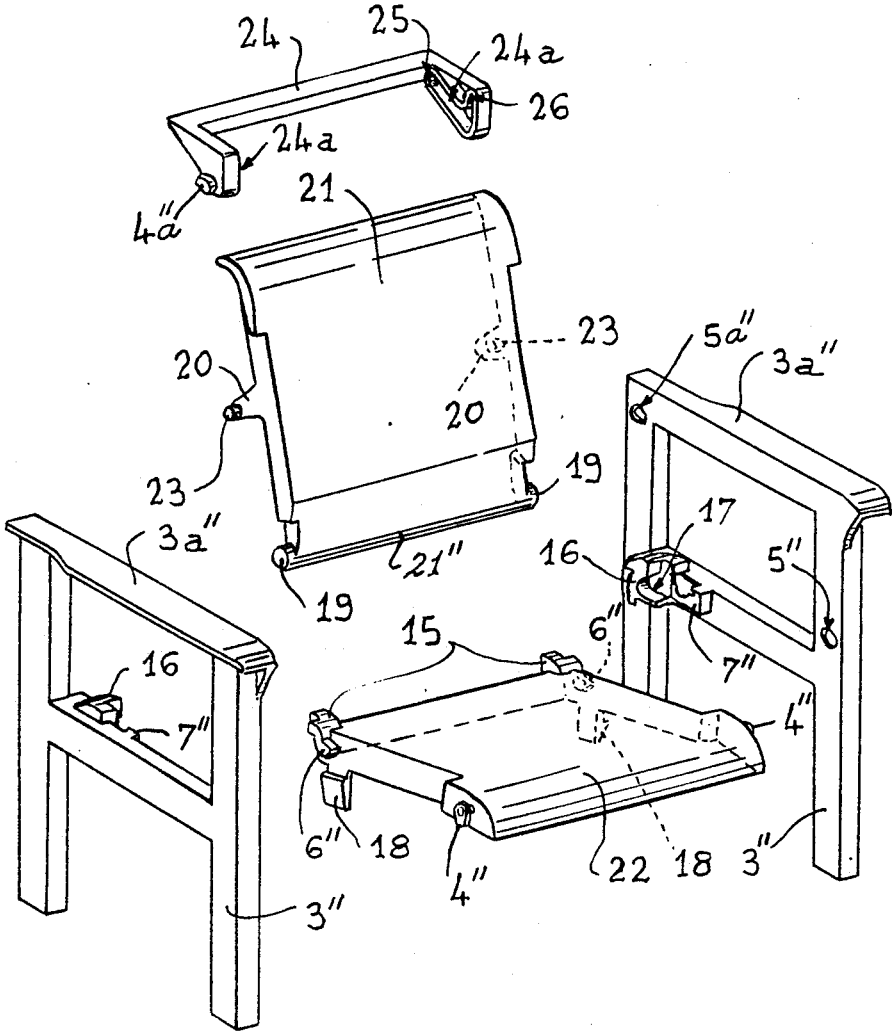
FIG. 10 is a view similar to FIG. 2 but showing an armchair with an inclining adjustable back.
Figure 11:
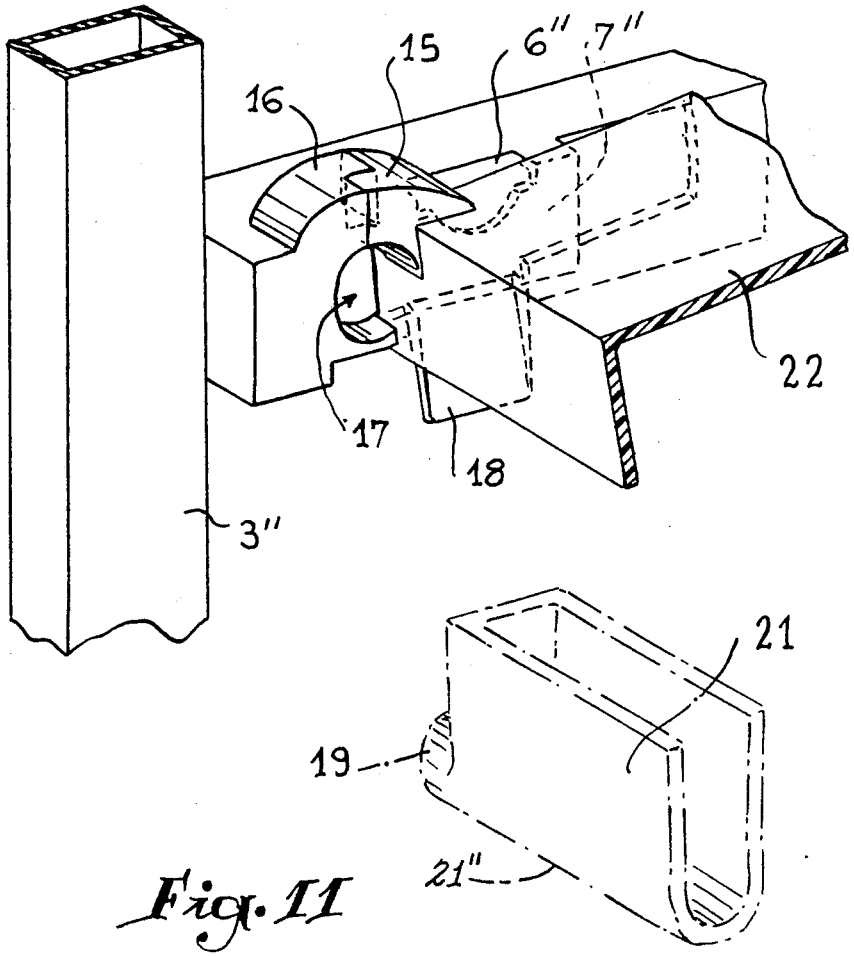
FIG. 11 shows one of both bearings provided on the sides of the armchair according to FIG. 10, and designed to accommodate the trunnions provided at the base of the back.
Figure 12:
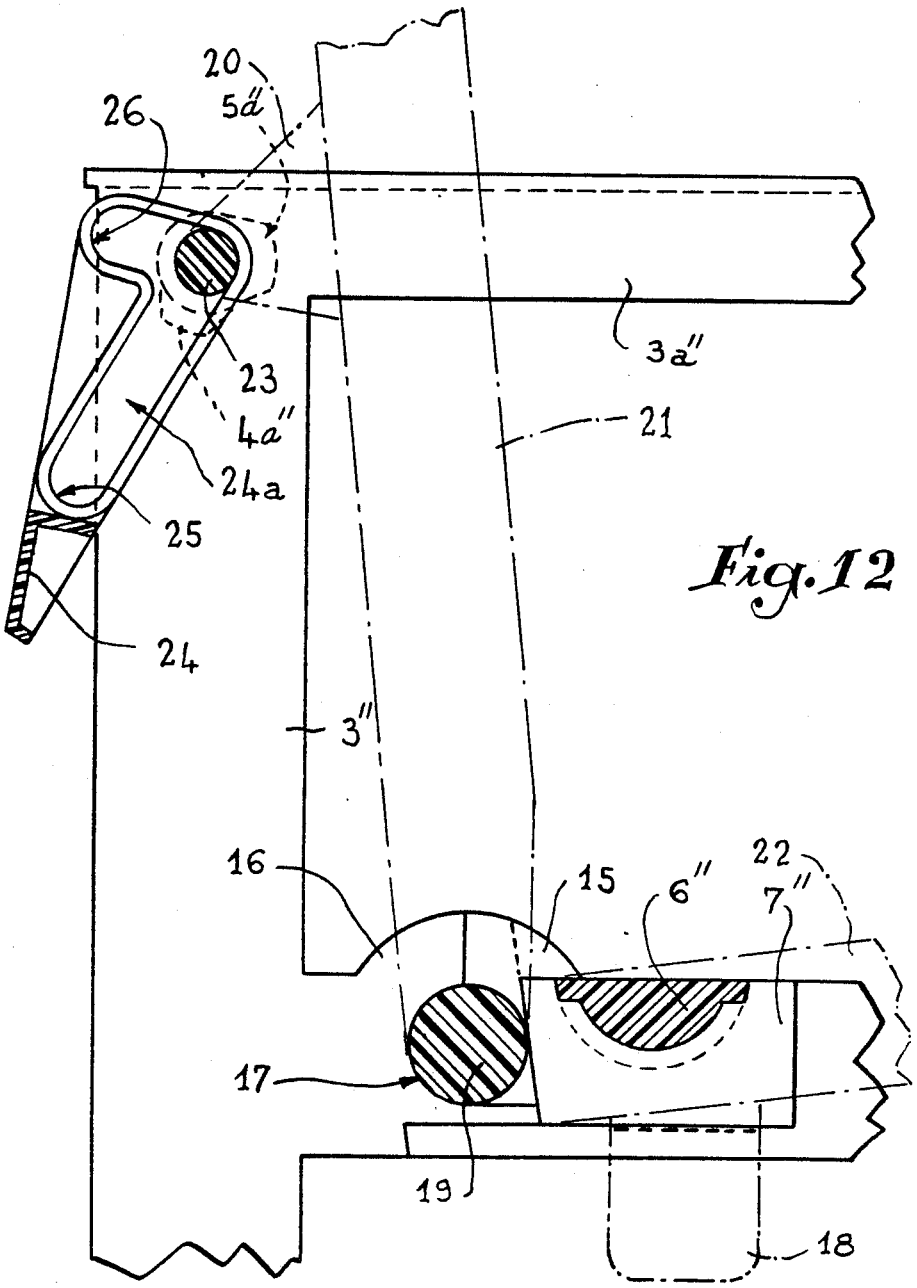
FIG. 12 is a vertical section showing the hinge assembly of the back and the adjusting means.

FIG. 10 shows the construction of a chair with an adjustable back according to the invention. It comprises two sides 3" which are substantially similar to the sides 3 and 3' and which cooperate with a back 21 and a seat 22. As FIGS. 11 and 12 more particularly show, the rear portion of seat 22 includes, behind each side lug 6", a projection 15, which in association with a half flange 16 provided in the side 3", forms as kind of shell that can be opened in two parts defining a cylindrical bearing 17. The bearing is utilized in place of the stops such as 3*b* of FIG. 1. In this case, the seat 22 is held by locking tongues 18, arranged to fit like a spring catch under the bearing 7" of the related side 3".

Both bearings 17 provided in the region of the rear portion of the seat 22 are intended for the pivotal mounting of two side trunnions 19 provided at the base 21" of the back 21. The trunnions permit tilting of the back with respect to the seat. In the upper portion of the back 21, two side tabs 20 are provided each having an outwardly oriented boss 23. The bosses are within a housing 24*a* provided in the lateral arms of an operating tilting bar 24.

Figure 13:
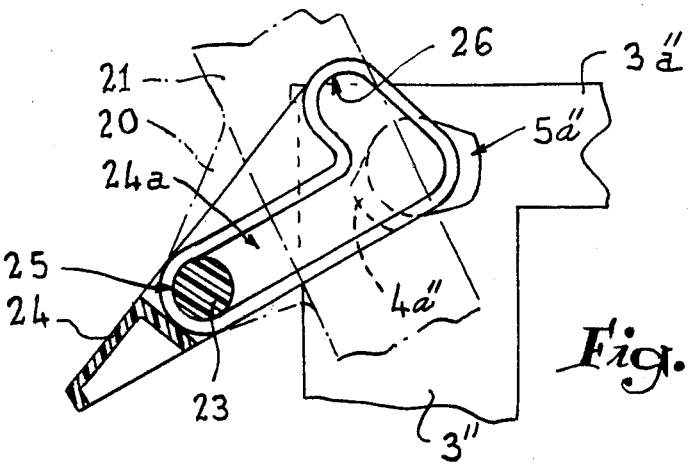
FIGS. 13 and 14 are partial reproductions of FIG. 12 with the back illustrated in the two inclined positions provided.
Figure 14:
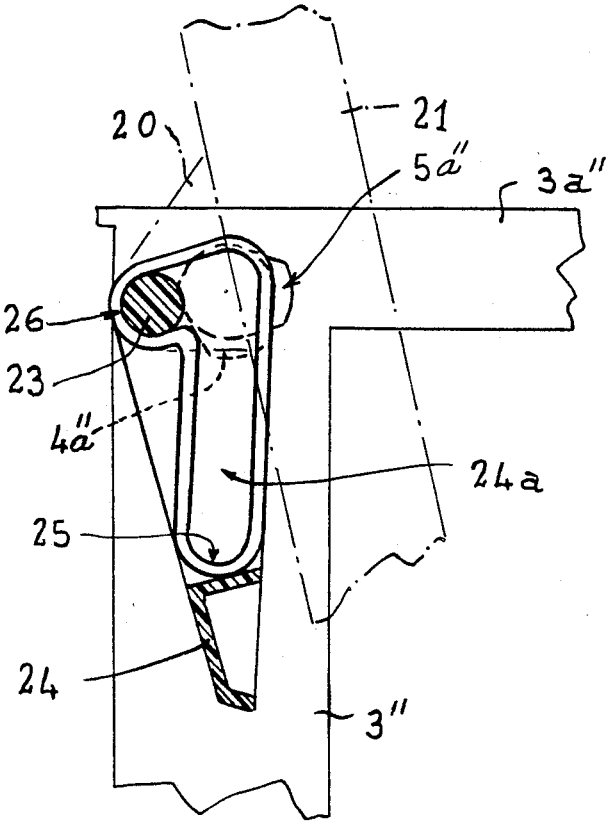

The outer wall of each arm is integrally provided with buttons or locking studs 4" that are shaped for engagement in the upper openings 5*a*" of sides 3" so that the middle portion of the back 21 is linked to the sides through bosses 23 and the operating bar 24. Since the housings 24*a* of the arms of the bar 24 feature as triangularly shaped profile with rounded angles, it is understood that bosses 23 can be in the angles 25 and 26 of FIGS. 13 and 14 thereby insuring the back 21 is secured in two perfectly stable yet differently inclined positions. The change from one position to the other is carried out by an angular displacement of the tilting bar 24 which involves the passage to an intermediate position shown at FIG. 12.

The seat 22 is pivotally connected adjacent its forward end to the sides 3" by buttons or locking studs 4" which are shaped and cooperatively received within openings 5" in the same manner as described with respect to FIG. 1. Armrests 3*a*" may also be provided.

Figure 9:
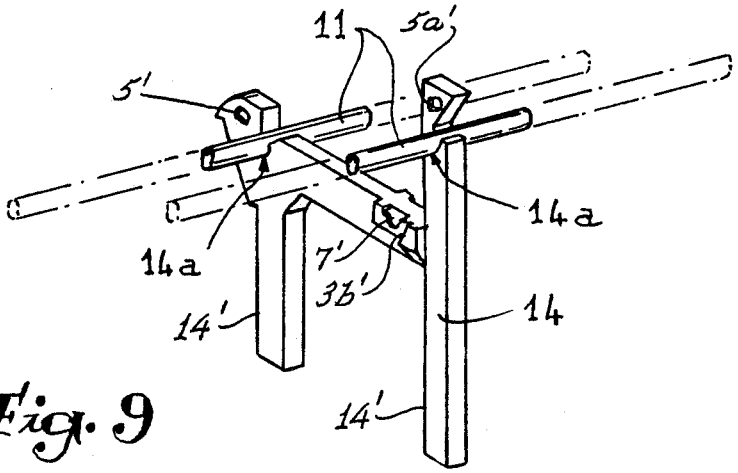
FIG. 9 is a perspective view of another type of intermediate support.

It is obvious that this form of embodiment of invention, in which the user can readily adjust the position of the back with respect to the seat, can be adopted for the carrying out of a multi-seater similar to that shown in FIGS. 8 and 9.

It must further be understood that the above description has been given for the purpose of illustration alone and that it no way restricts the extent of the scope of the invention from which it would not be departed by substituting the described details of execution by any other equal ones.

I claim:

1. A chair having assemblable components comprising a seat, a back and a pair of spaced sides, said seat having front and rear portions, said sides having a front portion and a rear portion, said back having upper and lower portions, a pair of oppositely oriented first locking studs extending outwardly of said front portion of said seat, said first locking studs having an irregularly shaped portion, a first opening in each of said front portions of said sides, said first openings being profiled so as to cooperatively receive said first locking studs therein when said seat and said sides are aligned in a non-use position and for cooperatively retaining said first locking studs when said seat and said sides are a proper alignment for use, a pair of second locking studs extending outwardly on opposite sides of said back and intermediate said upper and lower portions of said back, said second locking studs having an irregularly shaped portion, a second opening in each of said rear portions of said sides, said second opening being profiled so as to cooperatively receive said second locking studs when said back and said sides are aligned in a non-use position and for cooperatively retaining said second locking studs when said seat and said sides are in a proper alignment for use, a pair of lugs extending outwardly from said rear portion of said seat, a bearing member on each of said sides and adjacent said rear portions thereof, said lugs being cooperatively seated within said bearing members when said seat and said sides are aligned in a use position, and said sides have opposing stop members extending outwardly therefrom, said stop members being spaced adjacent to said bearing members and in spaced relationship below said second openings, said lower portion of said back abutting said stop members when said back is moved to a use position whereby said back and said seat may be cooperatively interlocked with said sides for assembled use.

2. The chair of claim 1 wherein said lower portion of said back includes a ledge extending forwardly thereof, said rear portion of said seat being seated upon said ledge when said back and said seat are in a use position.

3. The chair of claim 2 including an opening in said back adjacent said ledge, and latch means extending outwardly from said rear portion of said seat, said latch means being yieldably receivable through said opening when said rear portion of said seat is seated upon said ledge.

4. The chair of claim 1 including a pair of bracket members on each of said sides in vertically spaced relationship below each of said first and second openings, said bracket members of said sides being in opposing relationship with respect to one another, a pair of reinforcing bars extending between said sides and supported by said brackets, at least one intermediate support means engaging each of said reinforcing bars, said intermediate support means having opposite side portions, a pair of forward and rear openings in said side portions, said forward openings being generally horizontally aligned with respect to said first openings in said sides of the chair so as to cooperatively receive one of said first locking studs of said seat therein, said rear openings being generally horizontally aligned with respect to said second openings in said sides of the chair so as to cooperatively receive one of said second locking studs therein.

5. The chair of claim 4 in which said intermediate support means includes a second bearing member in each of said side portions thereof for selectively receiving one of said lugs of said seat.

6. The chair of claim 5 wherein said back includes a lower portion, each of said sides of the chair having a first stop member extending outwardly therefrom, said first stop members being spaced adjacent to said bearings and in spaced relationship below said second openings, a second stop member on each of said side portions of said intermediate support means adjacent to said second bearing members, said lower portion of said back abutting said first stop member of one of said sides of said chair and one of said second stop members of said intermediate support means when said back is moved to a use position.

7. The chair of claim 6 including at least two of said seats and two of said backs, one of said seats and backs mounted between one of said sides of the chair and said intermediate support means and the other of said seats and backs mounted between the other of said side and said intermediate support means.

8. The chair of claim 7 wherein said lower portion of said backs includes a ledge extending forwardly thereof, said rear portion of said seats being seated upon said ledges when said backs and said seats are in a use position and yieldable locking means to retain said seats in engagement with said backs.

9. The chair of claim 6 in which said intermediate support means includes a pair of spaced downwardly oriented bearing surfaces, each of said downwardly oriented bearing surfaces engaging one of said reinforcing bars whereby said intermediate support means is supported on said reinforcing bars.

10. The chair of claim 6 in which said intermediate support means includes a pair of spaced upwardly oriented bearing surfaces, one of said reinforcing bars being cooperatively seated in each of said upwardly oriented bearing surfaces, and leg means extending downwardly with respect to said reinforcing bars so as to be selectively engageable with a floor.

11. The chair of claim 1 wherein the back includes a lower portion, said lower portion including two outwardly extending cylindrical trunnions, and second bearings formed along each of said sides adjacent said first bearings, said trunnions being rotatably receivable within said second bearings.

12. The chair of claim 11 in which said second bearings are formed by a first arcuate flange formed in each of said sides and by projection means which extend rearwardly of said rear portion of said seat, said projections being adjacent each of said lugs.

13. The chair of claim 1 in which said back includes a pair of outwardly extending bosses on each side thereof in spaced vertical relationship above said lower portion, a tilt handle means having a central bar portion and a pair of spaced opposing open housings, said housings having inner and outer surfaces, said inner surfaces of each of said housings defining at least two angularly related channels, said bosses being selectively receivable within said channels of said housings so as to permit said handle to be moved along said channels relative to said bosses and said second locking studs being mounted to and extending outwardly with respect to said outer surfaces of said housings.

14. The chair of claim 11 in which said rear portion of said seat includes a pair of depending yieldable catch locks on each side thereof, said catch locks being selectively engageable with said sides to thereby prevent rotation of said seat relative to said sides.

15. The chair of claim 1 in which each of said first and second locking studs includes a first generally cylindrical portion which is integrally formed with said irregularly shaped portion and which spaces said irregularly shaped portion outwardly with respect to said seat and said back, respectively.

* * * * *